US009359106B2

(12) United States Patent
Bogdziewicz, III et al.

(10) Patent No.: US 9,359,106 B2
(45) Date of Patent: Jun. 7, 2016

(54) PRODUCT DISPENSING SYSTEM WITH MULTIPLE DISPENSING DECKS

(75) Inventors: William J. Bogdziewicz, III, Richmond, VA (US); Caleb S. Loftin, Richmond, VA (US); Aaron L. Bates, Moseley, VA (US); Steven Burton, Richmond, VA (US)

(73) Assignee: WestRock MWV, LLC, Norcross, GA (US)

( * ) Notice: Subject to any disclaimer, the term of this patent is extended or adjusted under 35 U.S.C. 154(b) by 14 days.

(21) Appl. No.: 13/184,639

(22) Filed: Jul. 18, 2011

(65) Prior Publication Data

US 2013/0020341 A1 Jan. 24, 2013

(51) Int. Cl.

| | |
|---|---|
| ***B65D 83/00*** | (2006.01) |
| ***B65D 5/72*** | (2006.01) |
| ***B65D 71/36*** | (2006.01) |
| ***A47F 1/12*** | (2006.01) |
| *A47F 1/08* | (2006.01) |

(52) U.S. Cl.

CPC . *B65D 5/725* (2013.01); *A47F 1/12* (2013.01); *B65D 71/36* (2013.01); *A47F 1/087* (2013.01)

(58) Field of Classification Search

USPC ..... 221/30–32, 92, 197, 199, 282, 284, 309

See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |

(Continued)

FOREIGN PATENT DOCUMENTS

| | | |
|---|---|---|
| DE | 2655496 | 6/1978 |
| DE | 29808673 | 11/1998 |

(Continued)

OTHER PUBLICATIONS

International Search Report and Written Opinion issued in PCT/US2010/057020 (Mar. 8, 2011).

(Continued)

*Primary Examiner* — Gene Crawford
*Assistant Examiner* — Kelvin L Randall, Jr.
(74) *Attorney, Agent, or Firm* — WestRock IP Legal

(57) ABSTRACT

A product dispensing frame having a front end and a rear end, and including an upper support deck extending between the front end and the rear end, a lower support deck positioned below the upper support deck, the lower support deck extending between the front end and the rear end and defining a first product display area, and an intermediate support deck positioned between the upper support deck and the lower support deck, the intermediate support deck extending between the front end and the rear end and defining a second product display area.

15 Claims, 6 Drawing Sheets

(56) References Cited

U.S. PATENT DOCUMENTS

| | | | | |
|---|---|---|---|---|
| 2,291,187 | A | 7/1942 | Johnson | |
| 2,382,191 | A * | 8/1945 | Weichselbaum | 312/45 |
| 2,536,421 | A | 2/1951 | Burhans | |
| 2,573,381 | A | 10/1951 | Arnold | |
| 2,574,087 | A | 11/1951 | Burhans | |
| 2,595,122 | A | 4/1952 | Burhans | |
| 2,784,871 | A | 3/1957 | Gabrielsen | |
| 2,795,845 | A | 6/1957 | Shimer | |
| 2,818,978 | A | 1/1958 | Post | |
| 2,826,471 | A | 3/1958 | Fonda | |
| 2,831,591 | A | 4/1958 | Morton | |
| 2,888,145 | A | 5/1959 | Knott et al. | |
| 2,915,932 | A | 12/1959 | Gross | |
| 2,919,488 | A | 1/1960 | Brownlee | |
| 2,996,344 | A | 8/1961 | Garman | |
| 3,018,149 | A | 1/1962 | Parker | |
| 3,055,293 | A | 9/1962 | Lariccia | |
| 3,066,827 | A | 12/1962 | Pryor | |
| 3,137,068 | A | 6/1964 | Quigley | |
| D198,888 | S | 8/1964 | Heselov | |
| 3,178,242 | A | 4/1965 | Ellis et al. | |
| 3,184,104 | A | 5/1965 | De Domenico et al. | |
| 3,203,554 | A | 8/1965 | Pendergrast et al. | |
| 3,204,335 | A | 9/1965 | Hughes | |
| 3,288,544 | A | 11/1966 | Knecht | |
| 3,300,115 | A | 1/1967 | Schauer | |
| 3,304,141 | A | 2/1967 | Rogers | |
| 3,306,688 | A | 2/1967 | Di Domenico | |
| 3,318,455 | A | 5/1967 | Takahashi | |
| 3,335,940 | A | 8/1967 | Dykes | |
| 3,340,790 | A | 9/1967 | Simjian | |
| 3,348,738 | A | 10/1967 | Hertlein | |
| 3,392,901 | A | 7/1968 | Krzyzanowski | |
| 3,393,808 | A * | 7/1968 | Chirchill | 211/59.2 |
| 3,501,016 | A | 3/1970 | Eaton | |
| 3,763,557 | A | 10/1973 | Sewell | |
| 3,784,022 | A | 1/1974 | Beesley, Jr. | |
| 3,922,778 | A | 12/1975 | Aalpoel | |
| 3,923,159 | A | 12/1975 | Taylor et al. | |
| 3,972,454 | A | 8/1976 | Croley | |
| 4,105,126 | A | 8/1978 | Deffner et al. | |
| 4,205,440 | A | 6/1980 | Morgan | |
| 4,260,072 | A | 4/1981 | Quasarano | |
| 4,318,458 | A | 3/1982 | Ritsema | |
| 4,382,526 | A | 5/1983 | Stone | |
| 4,396,143 | A | 8/1983 | Killy | |
| 4,435,026 | A | 3/1984 | Johnson | |
| 4,467,524 | A | 8/1984 | Ruff et al. | |
| 4,576,272 | A | 3/1986 | Morgan, Jr. et al. | |
| 4,598,828 | A | 7/1986 | Young et al. | |
| 4,729,480 | A | 3/1988 | Groover et al. | |
| 4,744,489 | A | 5/1988 | Binder et al. | |
| 4,834,263 | A | 5/1989 | Becze | |
| 4,869,395 | A | 9/1989 | Rubbmark | |
| 4,911,309 | A | 3/1990 | Stefan | |
| 4,915,571 | A | 4/1990 | Toshihiko et al. | |
| 4,923,070 | A | 5/1990 | Jackle et al. | |
| 4,997,106 | A | 3/1991 | Rockola | |
| 4,998,628 | A * | 3/1991 | Ross | 211/59.2 |
| 5,033,348 | A | 7/1991 | Walsh | |
| 5,080,256 | A | 1/1992 | Rockola | |
| 5,101,703 | A | 4/1992 | Tanaka et al. | |
| 5,167,345 | A | 12/1992 | Bleeker | |
| 5,190,155 | A | 3/1993 | Grunwald | |
| 5,251,972 | A | 10/1993 | Zurawin | |
| 5,289,943 | A | 3/1994 | Powell | |
| 5,314,078 | A | 5/1994 | Morikiyo et al. | |
| 5,328,258 | A | 7/1994 | Scalise | |
| 5,356,033 | A | 10/1994 | Delaney | |
| 5,372,278 | A | 12/1994 | Leight | |
| 5,390,821 | A | 2/1995 | Markel | |
| 5,396,997 | A | 3/1995 | Johnson | |
| D363,174 | S | 10/1995 | Fletcher, Sr. | |
| 5,462,198 | A | 10/1995 | Schwimmer | |
| 5,529,207 | A | 6/1996 | Oden et al. | |
| 5,638,988 | A | 6/1997 | Rogers et al. | |
| 5,685,664 | A | 11/1997 | Parham et al. | |
| 5,740,610 | A | 4/1998 | Ayer et al. | |
| 5,788,117 | A | 8/1998 | Zimmanck | |
| 5,791,048 | A | 8/1998 | Bodnar et al. | |
| 5,836,478 | A | 11/1998 | Weiss | |
| 5,878,862 | A | 3/1999 | Dewsnap | |
| 5,894,942 | A | 4/1999 | Miyashita et al. | |
| 5,924,573 | A | 7/1999 | Piraneo et al. | |
| 5,992,286 | A | 11/1999 | Boole | |
| 5,992,652 | A | 11/1999 | Springs | |
| 6,186,345 | B1 | 2/2001 | Robertson | |
| 6,199,720 | B1 | 3/2001 | Rudick et al. | |
| 6,206,237 | B1 | 3/2001 | Dillon et al. | |
| 6,253,930 | B1 | 7/2001 | Freidus et al. | |
| 6,267,258 | B1 | 7/2001 | Wilkerson et al. | |
| 6,393,799 | B2 * | 5/2002 | Jenkins et al. | 53/148 |
| 6,637,604 | B1 | 10/2003 | Jay | |
| 6,802,433 | B2 | 10/2004 | Leykin | |
| 6,991,116 | B2 | 1/2006 | Johnson et al. | |
| 7,207,447 | B2 | 4/2007 | Medcalf et al. | |
| 7,303,095 | B2 | 12/2007 | Nagelski et al. | |
| 7,478,725 | B2 * | 1/2009 | Holley, Jr. | 206/427 |
| 7,546,973 | B2 | 6/2009 | Budz et al. | |
| 7,584,854 | B2 | 9/2009 | Chandaria | |
| D604,972 | S | 12/2009 | Henry et al. | |
| 7,665,618 | B2 | 2/2010 | Jay et al. | |
| 7,681,745 | B2 | 3/2010 | Richter | |
| 7,810,672 | B1 | 10/2010 | Mason et al. | |
| 7,823,733 | B2 | 11/2010 | Futori | |
| 7,850,015 | B1 | 12/2010 | Mason | |
| 7,913,860 | B2 | 3/2011 | Merl | |
| 7,918,365 | B2 | 4/2011 | White et al. | |
| 7,922,437 | B1 | 4/2011 | Loftin et al. | |
| 8,028,855 | B2 | 10/2011 | White et al. | |
| 2002/0043509 | A1 | 4/2002 | Lajeunesse et al. | |
| 2004/0011751 | A1 | 1/2004 | Johnson et al. | |
| 2004/0079760 | A1 | 4/2004 | Rink | |
| 2004/0262326 | A1 | 12/2004 | Christensen | |
| 2005/0092644 | A1 | 5/2005 | Cafferata | |
| 2005/0127015 | A1 | 6/2005 | Medcalf et al. | |
| 2005/0207877 | A1 | 9/2005 | Haverdink | |
| 2006/0081692 | A1 | 4/2006 | Stewart et al. | |
| 2006/0237384 | A1 | 10/2006 | Neumann et al. | |
| 2006/0278591 | A1 * | 12/2006 | Tippets et al. | 211/59.2 |
| 2007/0194037 | A1 | 8/2007 | Close | |
| 2008/0245813 | A1 | 10/2008 | Johnson et al. | |
| 2009/0212066 | A1 * | 8/2009 | Bauer | 221/281 |
| 2009/0266776 | A1 | 10/2009 | Johnson | |
| 2009/0277853 | A1 | 11/2009 | Bauer | |
| 2010/0032391 | A1 | 2/2010 | Schneider et al. | |
| 2011/0121010 | A1 | 5/2011 | Loftin et al. | |
| 2011/0121011 | A1 | 5/2011 | Gelardi et al. | |
| 2012/0152970 | A1 * | 6/2012 | Thomas | 221/1 |

FOREIGN PATENT DOCUMENTS

| | | |
|---|---|---|
| DE | 19808162 | 9/1999 |
| DE | 20111307 | 10/2001 |
| DE | 202007012114 | 11/2007 |
| GB | 2190906 | 12/1987 |
| GB | 2303624 | 2/1997 |
| JP | 03105494 A | 5/1991 |
| JP | 03133737 A | 6/1991 |
| JP | 03198192 A | 8/1991 |
| JP | 03273469 A | 12/1991 |
| JP | 03273470 A | 12/1991 |
| JP | 03273471 A | 12/1991 |
| JP | 03273472 A | 12/1991 |
| JP | 03273474 A | 12/1991 |
| JP | 03273476 A | 12/1991 |
| JP | 03273477 A | 12/1991 |
| JP | 03273480 A | 12/1991 |
| JP | 03273482 A | 12/1991 |
| JP | 03273483 A | 12/1991 |
| JP | 04086985 A | 3/1992 |
| JP | 04115392 A | 4/1992 |
| JP | 04137194 A | 5/1992 |
| JP | 05004640 A | 1/1993 |

(56) References Cited

FOREIGN PATENT DOCUMENTS

| | | | |
|---|---|---|---|
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

OTHER PUBLICATIONS

International Search Report and Written Opinion issued in PCT/US2010/057221 (Mar. 4, 2011).

International Search Report and Written Opinion, PCT/US2012/045652 (2012).

* cited by examiner

PRODUCT DISPENSING SYSTEM WITH MULTIPLE DISPENSING DECKS

FIELD

This application relates to the dispensing of products from packaging containers and, more particularly, to dispensers for dispensing products initially provided in packaging containers.

BACKGROUND

Products are typically shipped to retailers in bulk by enclosing multiple individual product units in a container, such as a carton or box. For example, canned beverages may be shipped to a retailer in a carton containing twelve individual cans. When the products are to be sold individually, the retailer must remove the individual product units from the carton and stack them on a display, such as a shelf.

Alternatives to the traditional package-ship-unpack-display model have been developed in an effort to improve operating efficiency. For example, U.S. Pat. No. 7,922,437 issued on Apr. 12, 2011, the entire contents of which are incorporated herein by reference, discloses a system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity.

Despite advances already made in the field, those skilled in the art continue with research and development efforts directed to apparatus and systems for dispensing products initially provided in packaging containers.

SUMMARY

In one aspect, the disclosed product dispensing system may include a dispensing frame having a front end and a rear end, and including an upper support deck extending between the front end and the rear end, a lower support deck positioned below the upper support deck, the lower support deck extending between the front end and the rear end and defining a first product display area, and an intermediate support deck positioned between the upper support deck and the lower support deck, the intermediate support deck extending between the front end and the rear end and defining a second product display area.

In another aspect, the disclosed product dispensing system may include a container initially housing a plurality of products, a frame having longitudinally opposed front and rear ends and including an upper support deck extending at least partially between the front and rear ends, a lower support deck positioned below the upper support deck, the lower support deck defining a first product display area, and an intermediate support deck positioned between the upper support deck and the lower support deck, the intermediate support deck defining a second product display area, and an opening tool associated with the frame and arranged to open the container when the container is moved longitudinally along the upper support deck from the front end toward the rear end and allow the products to be at least partially dispensed from the container into the first and second product display areas.

In yet another aspect, disclosed is a method for dispensing a plurality of product initially provided in a container. The method may include the steps of (1) providing a dispenser including a frame having a front end and a rear end, the frame including an upper support deck extending at least partially between the front end and the rear end, a lower support deck positioned below the upper support deck, the lower support deck defining a first product display area, and an intermediate support deck positioned between the upper support deck and the lower support deck, the intermediate support deck defining a second product display area, (2) forming an opening in the container, and (3) positioning the container on the upper support deck such that a first quantity of products passes through the opening and moves toward the first product display area and, when the lower support deck is filled with the first quantity of products, a second quantity of products passes through the opening and moves toward the second product display area.

Other aspects of the disclosed product dispensing system and method will become apparent from the following detailed description, the accompanying drawings and the appended claims.

DETAILED DESCRIPTION

Figure 1:
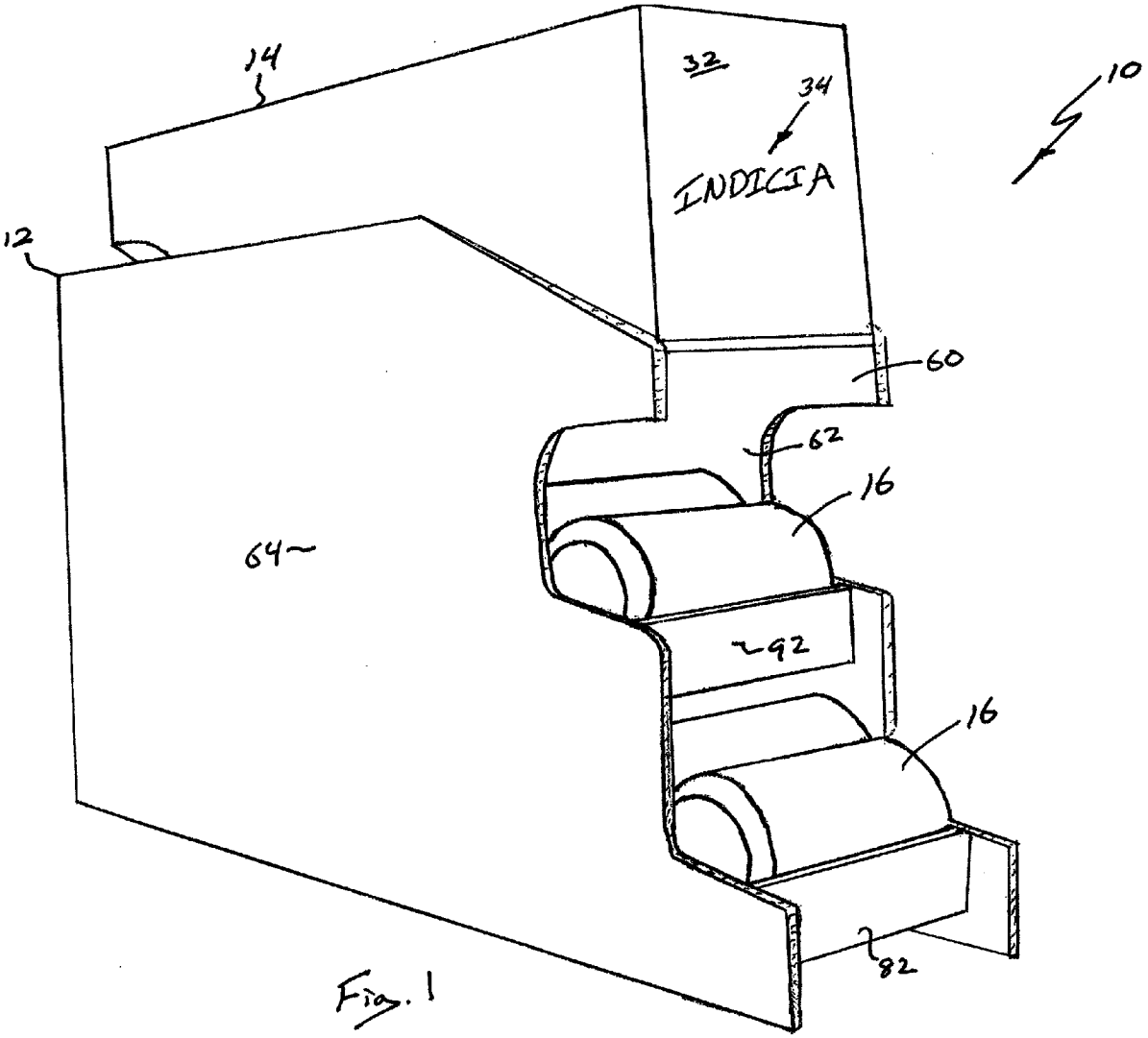
FIG. 1 is a front and side perspective view of one aspect of the disclosed product dispensing system with multiple dispensing decks.
Figure 2:
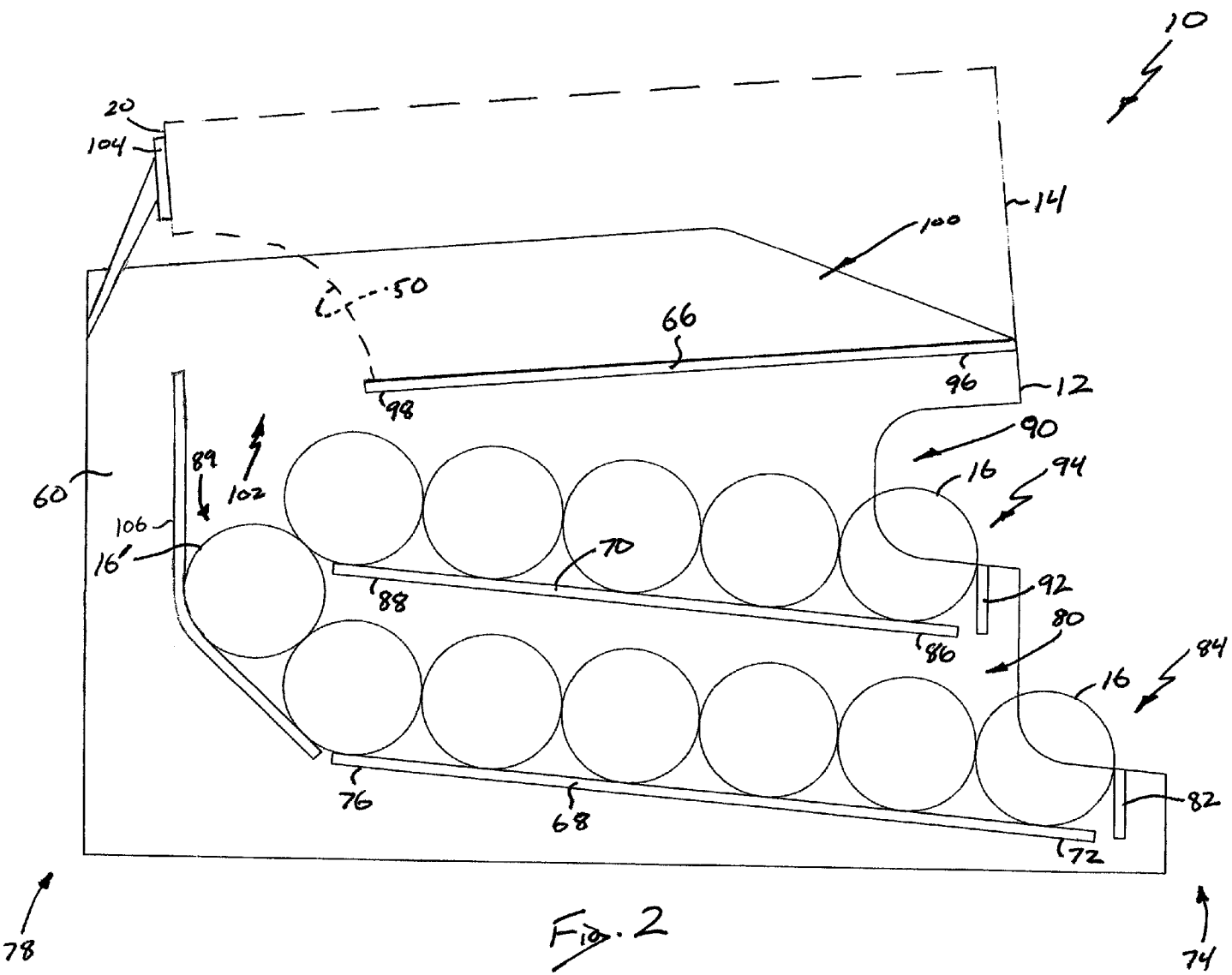
FIG. 2 is a side elevational view, in section, of the product dispensing system of FIG. 1.

Referring to FIGS. 1 and 2, one aspect of the disclosed product dispensing system with multiple dispensing decks, generally designated 10, may include a dispenser 12 and a container 14. The container 14 may initially house multiple units of product 16, such as cans (e.g., canned soft drinks), jars (e.g., jarred soup) or bottles (e.g., bottled sauce). The products 16 may be released from the container 14 into the dispenser 12 when the container 14 is opened and loaded onto the dispenser 12.

Figure 3:
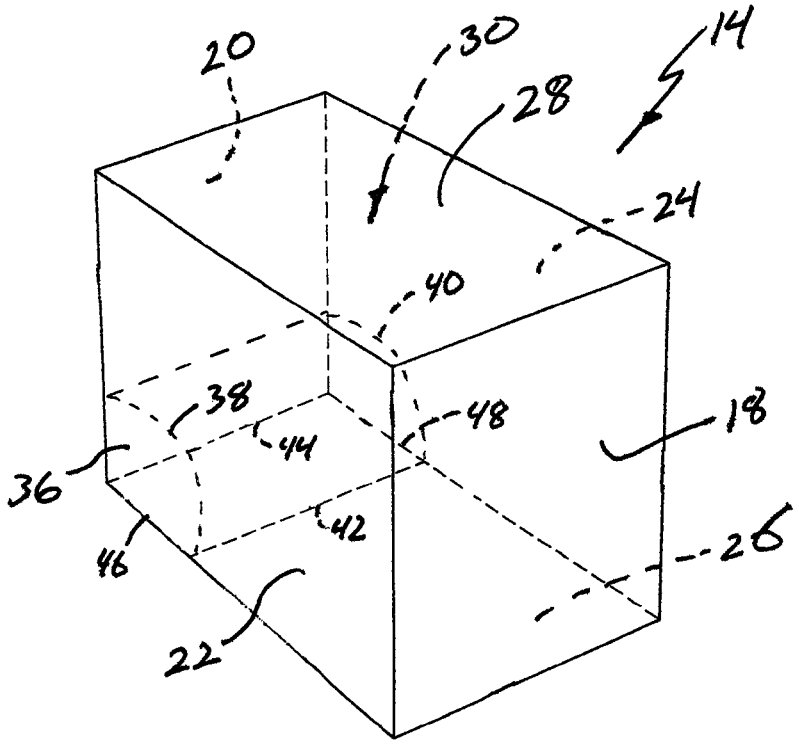
FIG. 3 is a front perspective view of the container of the product dispensing system of FIG. 1.

The container 14 may be any container capable of initially housing the products 16 and beneficially interacting with the dispenser 12. For example, as shown in FIG. 3, the container 14 may be a paperboard carton or a corrugated box having six walls 18, 20, 22, 24, 26, 28 that define an internal volume 30 for receiving the products 16 (FIGS. 1 and 2). Opposed walls 18, 20 may define the front and rear walls, respectively, of the container 14. Opposed walls 22, 24 may define the left and right side walls, respectively, of the container 14. Opposed walls 26, 28 may define the base and upper walls, respectively, of the container 14.

In accordance with well-established techniques, the container 14 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface of the container 14, and an uncoated second major surface. As another example, the stock material may be C2S paperboard, which may have a coating (e.g., clay) on both major surfaces thereof. Optionally, the outer surface 32 (FIG. 1) of the container 14 may be marked with various indicia 34 (FIG. 1), such as printed text and graphics.

Still referring to FIG. 3, the container 14 may include a removable opening feature 36. The removable opening feature 36 may be defined by weakened severance lines 38, 40, 42, 44, 46, 48 formed in the rear 20, side 22, 24 and base 26 walls of the container 14. The weakened severance lines 38, 40, 42, 44, 46, 48 may be formed by weakening the container 14, such as with score lines, perforations or zipper-like cuts, to facilitate tearing of the container 14 along the weakened severance lines 38, 40, 42, 44, 46, 48.

Figure 4:
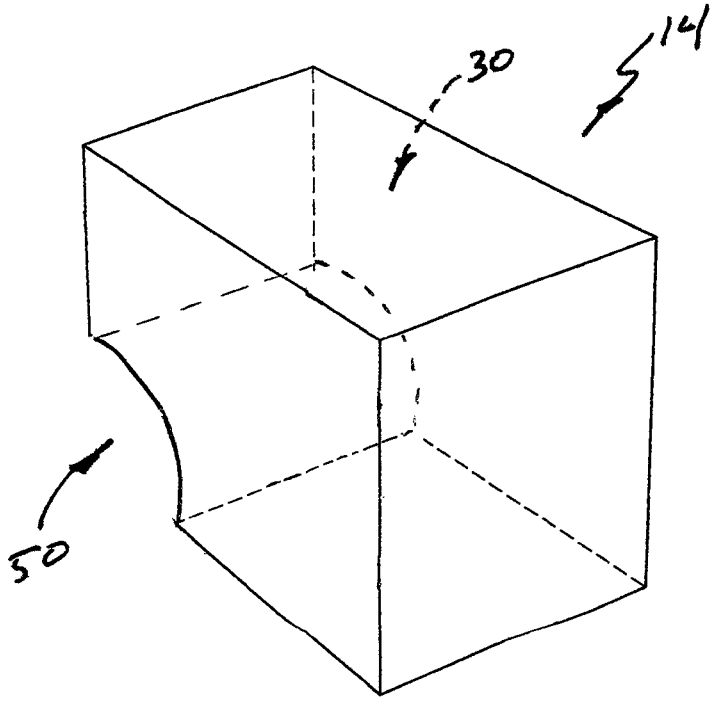
FIG. 4 is a front perspective view of the container of FIG. 3 shown in an open configuration

Thus, as shown in FIG. 4, the removable opening feature 36 may be removed from the container 14 to form an opening 50 into the internal volume 30 of the container 14. The opening 50 may extend generally laterally between the side walls 22, 24 of the container 14, and may be positioned proximate the rear wall 20 of the container 14 such that the products 16 (FIG. 1) may exit the container 14 through the opening 50. Those skilled in the art will appreciate that the step of removing the removable opening feature 36 from the container 14 may be performed prior to loading the container 14 onto the dispenser 12.

Referring back to FIGS. 1 and 2, the dispenser 12 may include a frame 60 that supports the container 14 in a desired configuration. The frame 60 may include a first (e.g., right) side wall 62, a second (e.g., left) side wall 64, an upper support deck 66, a lower support deck 68 and one or more intermediate support decks 70 (only one is shown in FIGS. 1 and 2) positioned between the upper support deck 66 and the lower support deck 68. The right side wall 62 may be laterally spaced from the left side wall 64, and may be generally parallel with the left side wall 64.

The lower support deck 68 may laterally extend between the right 62 and left 64 side walls, and may include a front end 72 that longitudinally extends toward the front end 74 of the frame 60 and a rear end 76 that longitudinally extends toward the rear end 78 of the frame 60. Therefore, the lower support deck 68 and the side walls 62, 64 may define a lower level 80 of the frame 60.

The lower support deck 68 may be inclined from the front end 72 to the rear end 76 (i.e., the rear end 76 may be elevated relative to the front end 72) such that products 16 deposited proximate the rear end 76 of the lower support deck 68 roll down to the front end 72 of the lower support deck 68 under the force of gravity. The extent of the incline of the lower support deck 68 may be dictated by, among other things, the coefficient of friction of the material used to form the frame 60 and the shape of the products 16 to be dispensed by the dispenser 12.

A stop 82 may be positioned proximate the front end 72 of the lower support deck 68 to prevent products 16 from rolling beyond the front end 72 of the lower support deck 68. Therefore, the stop 82 may collect products 16 at the front end 72 of the lower support deck 68, thereby defining a first product display area 84 proximate the front end 72 of the lower support deck 68.

The intermediate support deck 70 may be positioned between the upper support deck 66 and the lower support deck 68. The intermediate support deck 70 may laterally extend between the right 62 and left 64 side walls, and may include a front end 86 that longitudinally extends toward the front end 74 of the frame 60 and a rear end 88 that longitudinally extends toward, but not to, the rear end 78 of the frame 60. Therefore, the intermediate support deck 70 and the side walls 62, 64 may define an intermediate level 90 of the frame 60.

The spacing between the rear end 88 of the intermediate support deck 70 and the rear end 78 of the frame 60 may define an opening 89, which may function as a chute to allow products 16 to move from the intermediate level 90 down to the lower level 80 of the frame 60 under the force of gravity.

The intermediate support deck 70 may be inclined from the front end 86 to the rear end 88 (i.e., the rear end 88 may be elevated relative to the front end 86) such that products 16 deposited proximate the rear end 88 of the intermediate support deck 70 roll down to the front end 86 of the intermediate support deck 70 under the force of gravity. The extent of the incline of the intermediate support deck 70 may be dictated by, among other things, the coefficient of friction of the material used to form the frame 60 and the shape of the products 16 to be dispensed by the dispenser 12.

A stop 92 may be positioned proximate the front end 86 of the intermediate support deck 70 to prevent products 16 from rolling beyond the front end 86 of the intermediate support deck 70. Therefore, the stop 92 may collect products 16 at the front end 86 of the intermediate support deck 70, thereby defining a second product display area 94 proximate the front end 86 of the intermediate support deck 70. The second product display area 94 may be longitudinally displaced (e.g., inwardly) relative to the first product display area 84.

The upper support deck 66 may laterally extend between the right 62 and left 64 side walls, and may include a front end 96 that longitudinally extends toward the front end 74 of the frame 60 and a rear end 98 that longitudinally extends toward, but not to, the rear end 78 of the frame 60. Therefore, the upper support deck 66 and the side walls 62, 64 may define an upper level 100 of the frame 60.

The spacing between the rear end 98 of the upper support deck 66 and the rear end 78 of the frame 60 may define an opening 102, which may function as a chute to allow products 16 to move from the upper level 100 down to the intermediate 90 and lower 80 levels of the frame 60 under the force of gravity.

The upper support deck 66 may be declined from the front end 96 to the rear end 98 (i.e., the front end 96 may be elevated relative to the rear end 98). Therefore, products 16 supported on the upper support deck 66 may roll under the force of gravity down to the rear end 98 of the upper support deck 66, through the opening 102, to the lower and intermediate levels 80, 90 of the frame 60 and, ultimately, to the first and second product display areas 84, 94.

Optionally, a stop 104 may be connected proximate the rear end 78 of the frame 60. The stop 104 may extend into the upper level 100 of the frame 60 to inhibit rearward horizontal movement of the container 14 along the upper support deck 66 beyond the stop 104.

A guide 106 may be connected proximate the rear end 78 of the frame 60. The guide 106 may extend from proximate the opening 102 in the upper level 100 defined by the upper support deck 66, down through the opening 89 in the intermediate level 90 defined by the intermediate support deck 70 and, ultimately, down to the lower level 80 proximate the rear end 76 of the lower support deck 68.

Thus, the guide 106 may receive products 16 exiting through the opening 50 in the container 14 and may guide the products 16 down proximate the rear end 76 of the lower support deck 68, thereby allowing the products 16 guided to the lower level 80 to ultimately move to the first product display area 84. Once the lower level 80 of the frame 60 has been filled with products 16 such that the opening 89 in the intermediate level 90 is bridged by a product 16' (FIG. 2), the guide 106 may guide the products 16 down proximate the rear end 88 of the intermediate support deck 70, thereby allowing the products 16 guided to the intermediate level 90 to ultimately move to the second product display area 94.

The product dispensing system 10 may be assembled by opening the container 14 (e.g., tearing away the removable opening feature 36) and urging the opened container 14 along the upper support deck 66 of the dispenser 12 until the rear wall 20 of the container 14 comes into abutting engagement with the stop 104. With the opened container 14 loaded onto the dispenser 12, the force of gravity may urge the products 16 housed in the container 14 through the opening 50 in the container 14, down through the opening 102 in the upper level 100 of the frame 60 and, ultimately, to the first and second product display areas 84, 94.

Figure 5:
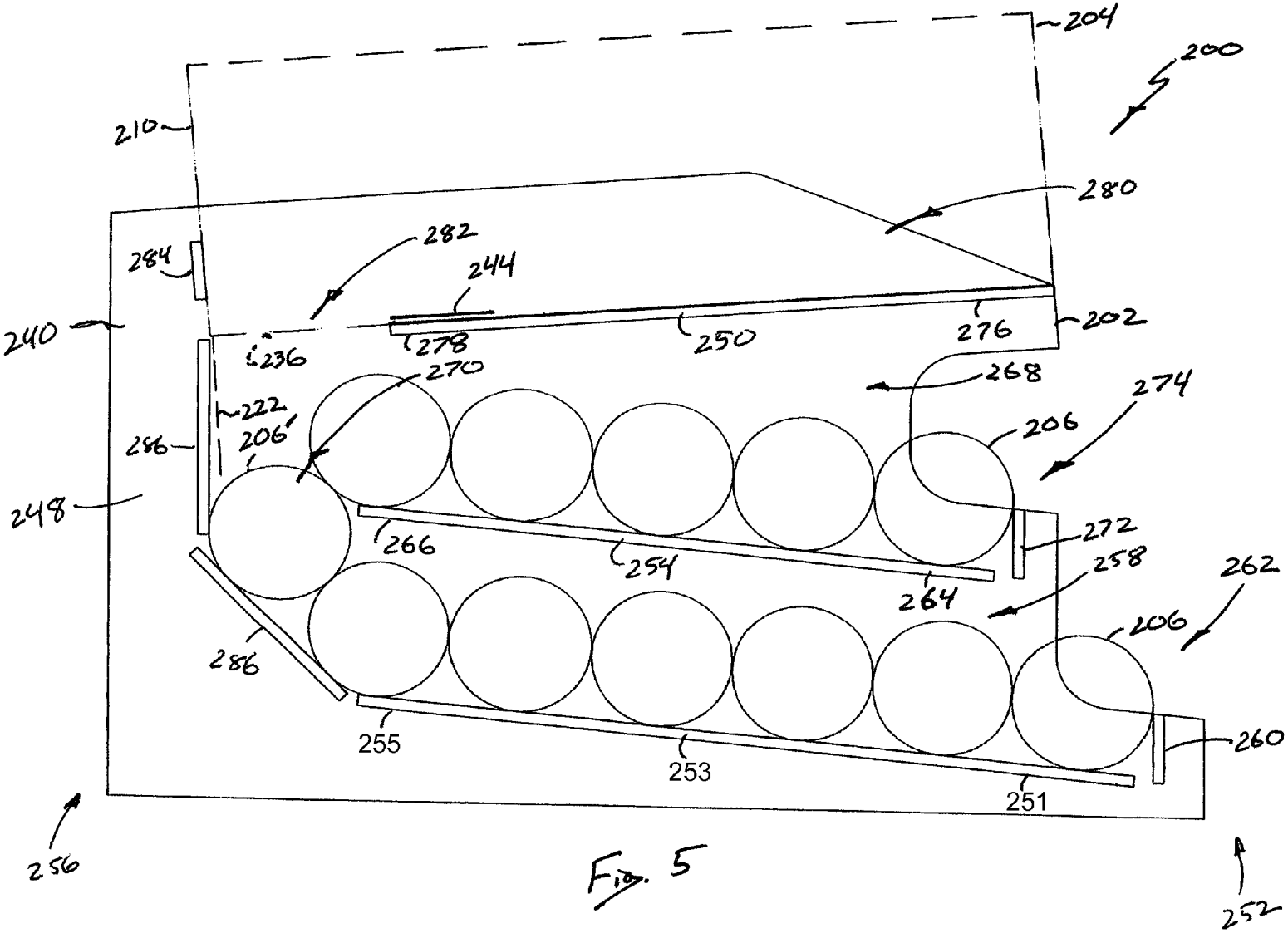
FIG. 5 is a side elevational view, in section, of another aspect of the disclosed product dispensing system with multiple dispensing decks.

Referring to FIG. 5, another aspect of the disclosed product dispensing system with multiple dispensing decks, generally designated 200, may include a dispenser 202 and a container 204. The container 204 may initially house multiple units of product 206 and may be opened to release the products 206 into the dispenser 202 when the container 204 is loaded onto the dispenser 202.

Figure 7:
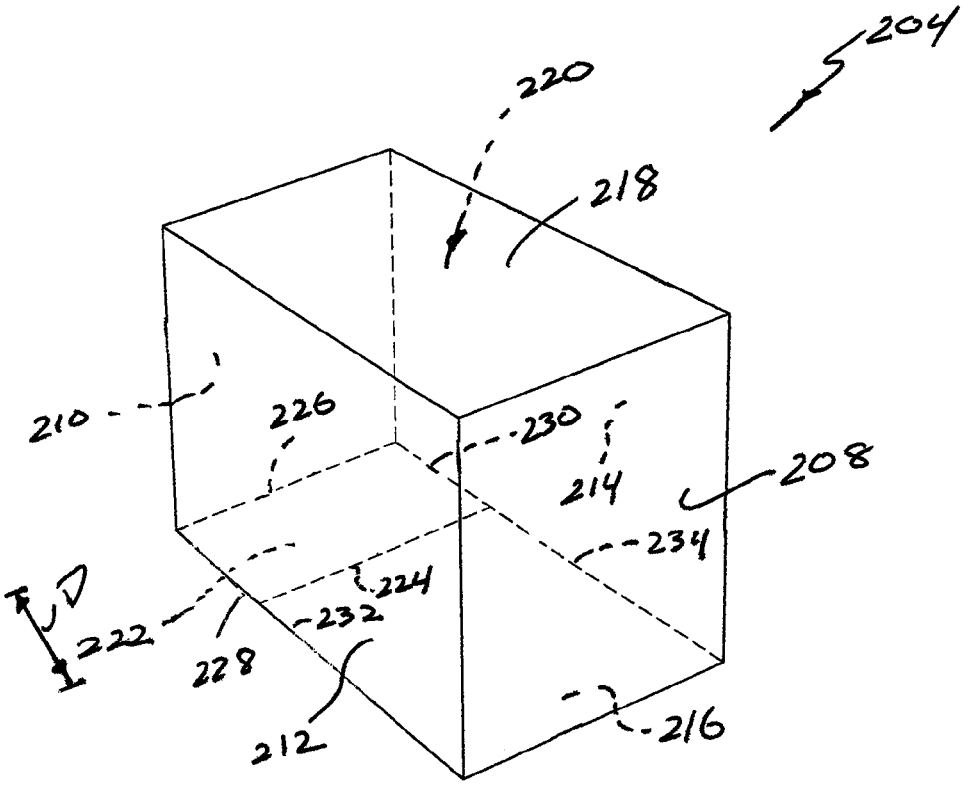
FIG. 7 is a front perspective view of the container of the product dispensing system of FIG. 5.
Figure 8:
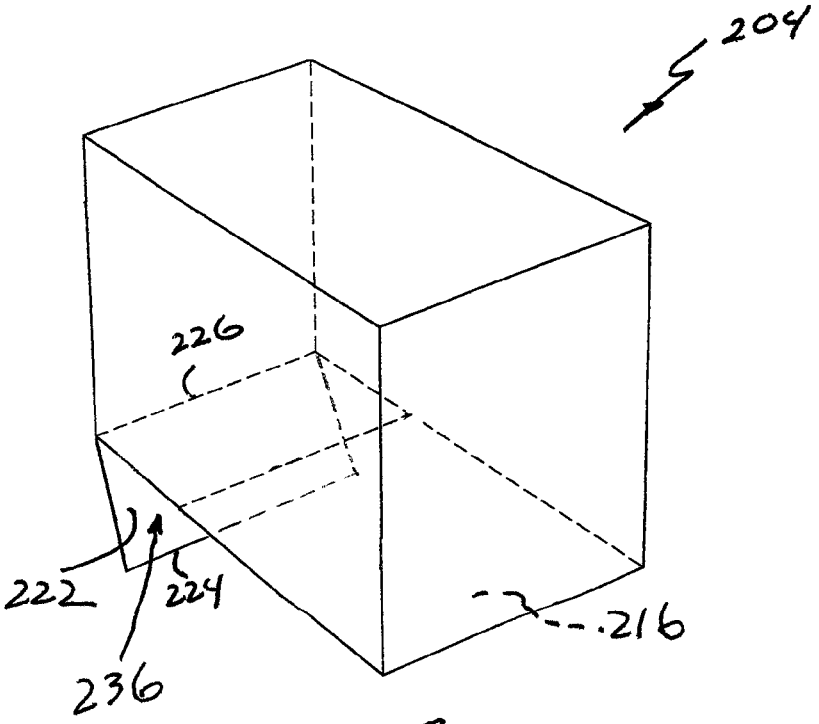
FIG. 8 is a front perspective view of the container of FIG. 7 shown in an open configuration.

Referring to FIGS. 7 and 8, the container 204 may have six walls 208, 210, 212, 214, 216, 218 that define an internal volume 220 for receiving the products 206 (FIG. 5). Opposed walls 208, 210 may define the front and rear walls, respectively, of the container 204. Opposed walls 212, 214 may define the left and right side walls, respectively, of the container 204. Opposed walls 216, 218 may define the base and upper walls, respectively, of the container 204.

The base wall 216 of the container 204 may define an access panel 222 that is openable to release the products 206 (FIG. 5) from the container 204. The access panel 222 may be defined by a free edge 224, a pre-formed pivot line 226, a first severance line 228 and a second severance line 230.

The pre-formed pivot line 226 may laterally extend across the base wall 216 (or the edge between the base wall 216 and the rear wall 210) of the container 204 from proximate the left side wall 212 to proximate the right side wall 214. The longitudinal distance D between the pre-formed pivot line 226 and the free edge 224 may define the longitudinal length of the access panel 222, and may be greater than the greatest diameter of the products 206 housed in the container 204.

The pre-formed pivot line 226 may be formed by weakening the container 204 along the pre-formed pivot line 226. Examples of weakening techniques useful in forming the pre-formed pivot line 226 include scoring the container 204, forming a crease in the container 204 and forming perforations in the container 204.

The first severance line 228 may longitudinally extend from the free edge 224 to the pre-formed pivot line 226. For example, the first severance line 228 may extend from the free edge 224 to the pre-formed pivot line 226 proximate the edge 232 between the base wall 216 and the left side wall 212.

The second severance line 230 may longitudinally extend from the free edge 224 to the pre-formed pivot line 226. For example, the second severance line 230 may extend from the free edge 224 to the pre-formed pivot line 226 proximate the edge 234 between the base wall 216 and the right side wall 214.

The first and second severance lines 228, 230 may be weakened to make it easier to sever the first and second severance lines 228, 230. However, the first and second severance lines 228, 230 may have sufficient strength such that the first and second severance lines 228, 230 are not severed merely due to the weight of the products 206 housed in the container 204 acting on the access panel 222. Several examples of techniques that may be used to weaken the first and second severance lines 228, 230 include forming perforations in the container 204 along the first and second severance lines 228, 230, scoring the container 204 and forming creases in the container 204.

The free edge 224 may laterally extend across the base wall 216 of the container 204 from proximate the left side wall 212 to proximate the right side wall 214. The free edge 224 may be spaced a longitudinal distance D from the pre-formed pivot line 226.

In one implementation, the free edge 224 may be defined by a severance line that must be severed to free the free edge 224. In a first expression, the free edge 224 may be freed by severing the severance line defining the free edge 224 prior to loading the container 204 onto the dispenser 202. For example, the free edge 224 may be freed by pulling a zipper strip from the container 204 prior to loading the container 204 onto the dispenser 202. In a second expression, the free edge 224 may be freed by severing the severance line defining the free edge 224 as the container 204 is being loaded onto the dispenser 202.

As shown in FIG. 8, when the free edge 224 is free and the first and second severance lines 228, 230 have been severed, the access panel 222 may pivot relative to the base wall 216 about the pre-formed pivot line 226 to form an opening 236. The opening 236 may be of a sufficient size and shape to allow products 206 (FIG. 5) to pass therethrough.

In one implementation, the first and second severance lines 228, 230 may be severed to release the access panel 222 as the container 204 is loaded onto the dispenser 202, as described in greater detail herein. In another implementation, the first and second severance lines 228, 230 may be severed to release the access panel 222 prior to loading the container 204 onto the dispenser 202, such as by manually severing the first and second severance lines 228, 230 (e.g., with a knife or box cutter).

Figure 6:
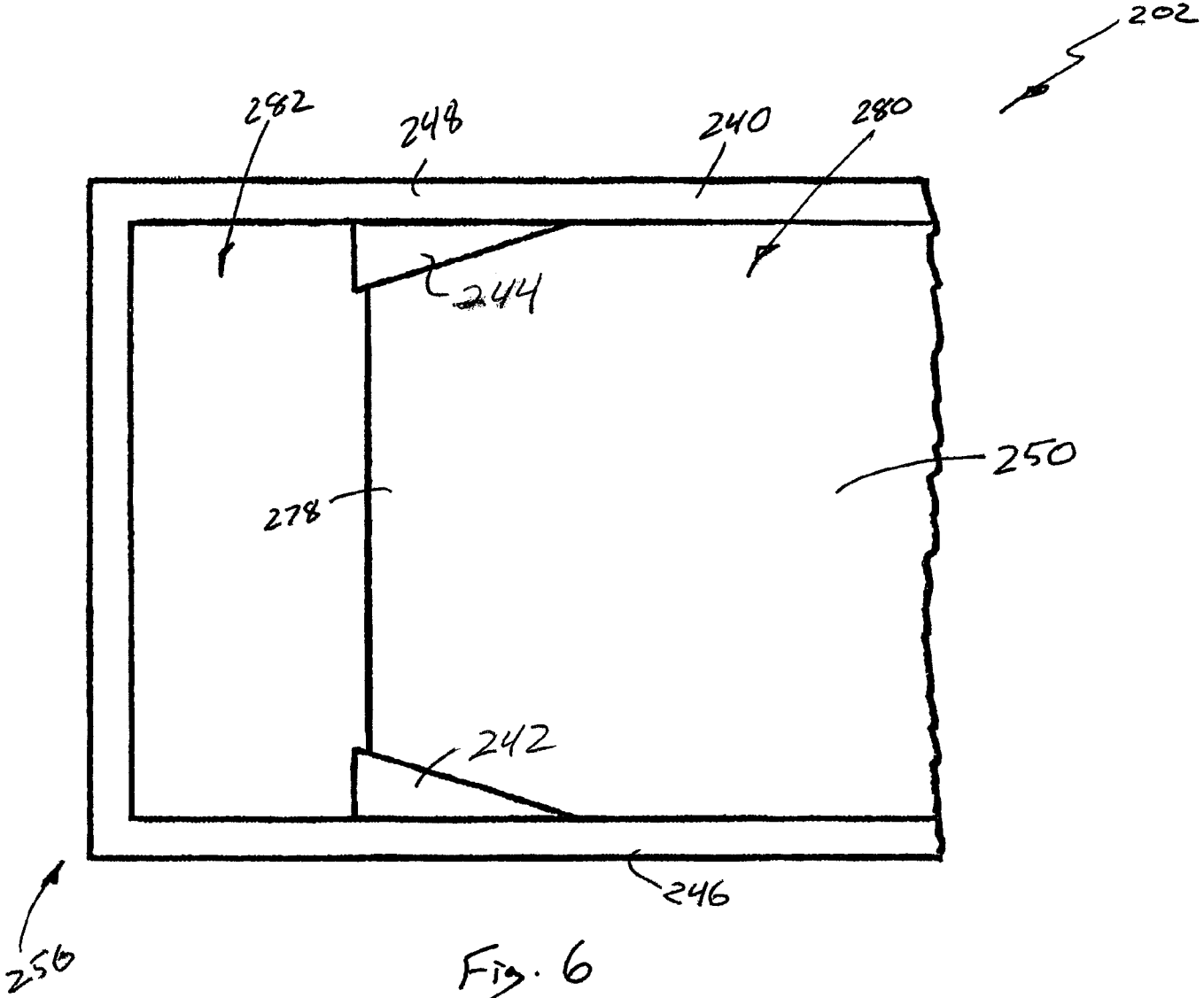
FIG. 6 is a top plan view of a portion of the dispenser of the product dispensing system of FIG. 5.

Referring to FIGS. 5 and 6, the dispenser 202 may include a frame 240 and one or more opening tools 242, 244. The frame 240 may support the container 204 in a desired configuration, as shown in FIG. 5. The opening tools 242, 244 may sever the first and second severance lines 228, 230 (FIG. 7) to release the access door 222 and form the opening 236 (FIG. 8) in the container 204 as the container 204 is loaded onto the frame 240, thereby releasing the products 206 from the container 204 to the dispenser 202.

The frame 240 may include left and right side walls 246, 248, an upper support deck 250, a lower support deck 253 and an intermediate support deck 254 positioned between the upper support deck 250 and the lower support deck 253. The right side wall 248 may be laterally spaced from the left side wall 246, and may be generally parallel with the left side wall 246.

The lower support deck 253 may laterally extend between the side walls 246, 248, and may include a front end 251 that longitudinally extends toward the front end 252 of the frame 240 and a rear end 255 that longitudinally extends toward the rear end 256 of the frame 240. Therefore, the lower support deck 253 and the side walls 246, 248 may define a lower level 258 of the frame 240.

The lower support deck 253 may be inclined from the front end 251 to the rear end 255, and may include a stop 260 positioned proximate the front end 251 of the lower support deck 253, thereby defining a first product display area 262 proximate the front end 251 of the lower support deck 253.

The intermediate support deck 254 may be positioned between the upper support deck 250 and the lower support deck 253. The intermediate support deck 254 may laterally extend between the side walls 246, 248, and may include a front end 264 that longitudinally extends toward the front end 252 of the frame 240 and a rear end 266 that longitudinally extends toward, but not to, the rear end 256 of the frame 240. Therefore, the intermediate support deck 254 and the side walls 246, 248 may define an intermediate level 268 of the frame 60.

The spacing between the rear end 266 of the intermediate support deck 254 and the rear end 256 of the frame 240 may define an opening 270, which may function as a chute to allow products 206 to move from the intermediate level 268 down to the lower level 258 of the frame 240 under the force of gravity.

The intermediate support deck 254 may be inclined from the front end 264 to the rear end 266, and may include a stop 272 positioned proximate the front end 264 of the intermediate support deck 254, thereby defining a second product display area 274 proximate the front end 264 of the intermediate support deck 254.

Additional intermediate support decks (not shown), which may define additional intermediate levels and associated product display areas, may be provided between the upper support deck 250 and the lower support deck 253 without departing from the scope of the present disclosure.

The upper support deck 250 may laterally extend between the side walls 246, 248, and may include a front end 276 that longitudinally extends toward the front end 252 of the frame 240 and a rear end 278 that longitudinally extends toward, but not to, the rear end 256 of the frame 240. Therefore, the upper support deck 250 and the side walls 246, 248 may define an upper level 280 of the frame 240.

The spacing between the rear end 278 of the upper support deck 250 and the rear end 256 of the frame 240 may define an opening 282, which may function as a chute to allow products 206 to move from the upper level 280 down to the intermediate 268 and lower 258 levels of the frame 240 under the force of gravity.

The upper support deck 250 may be declined from the front end 276 to the rear end 278 such that products 206 supported on the upper support deck 250 may roll under the force of gravity down to the rear end 278 of the upper support deck 250, through the opening 282, to the lower and intermediate levels 258, 268 of the frame 240 and, ultimately, to the first and second product display areas 262, 274.

An optional stop 284 may be disposed proximate the rear end 256 of the frame 240. The stop 284 may inhibit rearward horizontal movement of the container 204 along the upper support deck 250 beyond the stop 284.

A guide 286 may be connected proximate the rear end 256 of the frame 240. The guide 286 may receive products 206 exiting through the opening 236 (FIG. 8) in the container 204 and may guide the products 206 down through the opening 282 in the upper level 280, through the opening 270 in the intermediate level 268 and, ultimately, proximate the rear end 256 of the lower support deck 253, thereby allowing the products 206 to move to the first product display area 262 under the force of gravity. Once the lower level 258 of the frame 240 has been filled with products 206 such that the opening 270 in the intermediate level 268 is bridged by a product 206' (FIG. 5), the products 206 guided through the opening 282 in the upper level 280 may accumulate on the intermediate support deck 254, thereby allowing the products 206 to move to the second product display area 274 under the force of gravity.

The opening tools 242, 244 may be positioned in the upper level 280 of the frame 240 to sever the first and second severance lines 228, 230 (FIG. 7), respectively, of the container 204 as the container 204 is urged along the upper support deck 250 of the frame 240. The type of opening tools 242, 244 used, as well as the position of the opening tools 242, 244 relative to the frame 240, may depend on the configuration of the access panel 222 (FIG. 7) of the container 204, among other things.

In one particular construction, the opening tools 242, 244 may be cutting elements (e.g., knife blades) that inwardly protrude from the side walls 246, 248 proximate the rear end 278 of the upper support deck 250. For example, opening tool 242 may be connected to the left side wall 242 of the frame 240 and opening tool 244 may be connected to the right side wall 248 of the frame 240. Therefore, the opening tools 242, 244 may sever the first and second severance lines 228, 230 (FIG. 7) as the container 204 is urged toward the stop 284 along the upper support deck 250 of the frame 240, thereby allowing the access panel 222 to pivot about the pre-formed pivot line 226 to form the opening 236 in the container 204.

At this point, those skilled in the art will appreciate that opening tools 242, 244 are only one specific example of suitable opening tools, and that various alternative opening tools may be used without departing from the scope of the present disclosure. As one example, the opening tool may include a cutting element positioned to form access panels in the container 204 that open laterally outward, as described in U.S. Pat. No. 7,922,437 (discussed above). As another example, the opening tool may include a forward-protruding catch element, such as the forward-protruding catch element disclosed in U.S. Ser. No. 12/891,391 filed on Sep. 27, 2010, the entire contents of which are incorporated herein by reference, or the forward-protruding catch element disclosed in U.S. Ser. No. 13/032,734 filed on Feb. 23, 2011, the entire contents of which are incorporated herein by reference. As yet another example, the opening tool may include a rear-protruding catch element, such as the rear-protruding catch element disclosed in U.S. Ser. No. 12/970,683 filed on Dec. 16, 2010, the entire contents of which are incorporated herein by reference.

The product dispensing system 200 may be assembled to dispense products 206 by positioning the container 204 onto the front end 276 of the upper support deck 250 of the frame 240 and urging the container 204 along the upper support deck 250 toward the stop 284. As the container moves relative to the opening tools 242, 244, the opening tools 242, 244 may sever the first and second severance lines 228, 230, thereby allowing the access panel 222 to pivot relative to the base wall 216 about the pre-formed pivot line 226. As the container 204 continues to move rearward, the access panel 222 may drop through the opening 282 in the upper level 280 of the frame 240 to form the opening 236 in the container 204, thereby allowing the products 206 in the container 204 to exit the container 204 through the opening 236 under the force of gravity. As the products 206 exit the container 204, the guide 286 may guide the products 206 down through the opening 282 in the upper level 280 of the frame 240 and, ultimately, to the first and second product display areas 262, 274.

Accordingly, the disclosed product dispensing systems employ multiple support decks with product display areas, thereby increasing the amount of product being displayed to potential consumers and increasing the amount of product that may be supported by a given dispenser. Furthermore, the disclosed product dispensing systems may improve stocking efficiency by optionally employing an opening tool configured to automatically open a container as the container is loaded onto the dispenser.

Although various aspects of the disclosed product dispensing system with multiple dispensing decks have been shown and described, modifications may occur to those skilled in the art upon reading the specification. The present application includes such modifications and is limited only by the scope of the claims.

What is claimed is:

1. A product dispensing system comprising:

a dispenser frame having a front end and a rear end, said dispenser frame comprising:

an upper support deck extending between said front end and said rear end, said upper support deck comprising a deck rear end, wherein said deck rear end of said upper support deck defines an opening proximate said rear end of said dispenser frame;

an opening tool proximate the rear end of the upper support deck;

a lower support deck positioned below said upper support deck, said lower support deck extending between said front end and said rear end and defining a first product display area, wherein said lower support deck slopes downward toward said first product display area; and an intermediate support deck positioned between said upper support deck and said lower support deck, said intermediate support deck extending between said front end and said rear end and defining a second product display area, wherein said intermediate support deck slopes downward toward said second product display area;

a container positioned on said upper support deck and initially housing a plurality of products each having a diameter, the container comprising: a base wall, a rear wall, two side walls extending from the base wall and connected to the base wall along opposed longitudinal side edges of the base wall, and an opening formed in the base wall when the container is moved longitudinally along the upper support deck from the front end to the rear end; and wherein the opening tool creates said opening in said container by cutting a first severance line proximate to and parallel with a first one of the opposed longitudinal side edges and a second severance line proximate to and parallel with a second one of the opposed longitudinal side edges, wherein said opening in said container is initially closed by an opening feature defined at least partly by said severance lines, the container after first contacting the opening tool traveling further along the upper support deck by a distance at least as large as the product diameter, wherein the products are dispensed through the opening in the base wall when the opening in the base wall is located rearward of the opening tool.

2. The product dispensing system of claim 1 wherein said first product display area is proximate said front end.

3. The product dispensing system of claim 2 wherein said second product display area is proximate said front end.

4. The product dispensing system of claim 1 wherein said dispenser frame further comprises a guide extending from proximate said upper support deck to proximate said lower support deck.

5. The product dispensing system of claim 1 wherein at least a first product of said plurality of products is positioned in said first product display area and at least a second product of said plurality of products is positioned in said second product display area.

6. The product dispensing system of claim 1 wherein said second product display area is longitudinally displaced relative to said first product display area.

7. The product dispensing system of claim 1 wherein said frame comprises first and second laterally opposed side walls.

8. The product dispensing system of claim 7 wherein said opening tool is connected to said first side wall.

9. The product dispensing system of claim 8 further comprising a second opening tool connected to said second side wall.

10. The product dispensing system of claim 1 wherein the opening tool is connected to said upper support deck.

11. The product dispensing system of claim 1, wherein the weakened severance lines are selected from the group consisting of perforations, cuts, and score lines.

12. The product dispensing system of claim 11, wherein the cuts comprise zipper-like cuts.

13. The product dispensing system of claim 10, wherein the opening tool is arranged to automatically form the opening in the container and at least partially dispense the plurality of products from the container through the opening in the container to one of the lower support deck and the intermediate support deck under a force of gravity when the container is moved along the upper support deck from the front end toward the rear end.

14. The product dispensing system of claim 1, wherein the dispenser frame further comprises a stop extending into an area above the upper support deck to inhibit rearward horizontal movement of the container along the upper support deck beyond the stop.

15. A product dispensing system comprising:

a dispenser frame having a front end and a rear end, the dispenser frame comprising:

an upper support deck extending from the front end toward the rear end and comprising an upper support deck rear end, with a dispenser frame opening between the upper support deck rear end and the rear end of the dispenser frame;

an opening tool proximate an upper surface of the upper support deck;

a lower support deck positioned below the upper support deck, the lower support deck sloping downward from the rear end toward the front end and defining a first product display area proximate the front end; and an intermediate support deck positioned between the upper support deck and the lower support deck, the intermediate support deck sloping downward from the rear end toward the front end and defining a second product display area proximate the front end;

a container positioned on the upper support deck and initially housing a plurality of products each having a diameter, the container comprising a base wall, a rear wall, and two side walls extending from opposed side edges of the base wall, and a container opening formed in the base wall of the container; and wherein the opening tool creates the container opening by cutting a first severance line proximate to and parallel with a first one of the opposed side edges and a second severance line proximate to and parallel with a second one of the opposed side edges, wherein said opening in said container is initially closed by an opening feature defined at least partly by said severance lines, the container after first contacting the opening tool traveling further along the upper support deck by a distance at least as large as the product diameter; and wherein the articles are dispensed through the opening when the opening in said container is located rearward of the opening tool.

* * * * *